United States Patent [19]

Persson

[11] 4,353,738

[45] Oct. 12, 1982

[54] LEAD SMELTING METHOD

[75] Inventor: John A. Persson, Gibsonia, Pa.

[73] Assignee: Lectromelt Corporation, Pittsburgh, Pa.

[21] Appl. No.: 264,447

[22] Filed: May 18, 1981

[51] Int. Cl.[3] ..... C22B 4/00

[52] U.S. Cl. ..... 75/10 R; 75/14; 75/77

[58] Field of Search ..... 75/77, 10 R, 14

[56] References Cited

U.S. PATENT DOCUMENTS

| | | | |
|---|---|---|---|
| 815,221 | 3/1906 | Ruthenburg . | |
| 842,273 | 1/1907 | Tone . | |
| 1,101,551 | 6/1914 | Humbert . | |
| 2,006,256 | 6/1935 | Betterton et al. . | |
| 2,715,062 | 8/1955 | Osborn | 75/14 |
| 2,769,706 | 11/1956 | Herneryd | 75/77 |
| 3,137,569 | 6/1964 | Hammond . | |
| 4,073,640 | 2/1978 | Soykan . | |
| 4,162,915 | 7/1979 | Maes | 75/14 |

*Primary Examiner*—P. D. Rosenberg
*Attorney, Agent, or Firm*—Fred Wiviott

[57] ABSTRACT

A method of smelting lead comprises the steps of containing a quantity of crude lead in an electric arc furnace, disposing a layer of coke or carbon granules over said lead, disposing at least two spaced apart electrodes in contact with said granules, energizing said electrodes for passing an electric current through said granules for heating said lead to at least its fusion temperature, and withdrawing the molten lead from beneath the granules.

6 Claims, 1 Drawing Figure

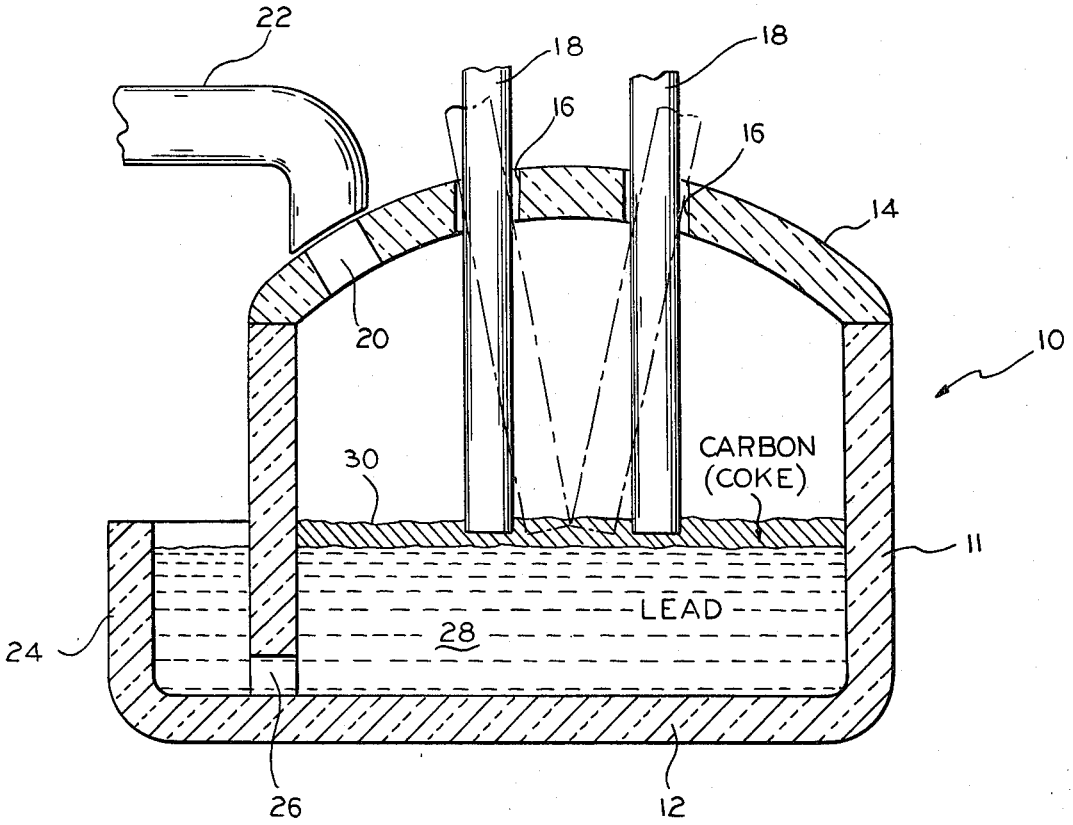
22
18
18
16
16
14
20
10
30
CARBON
(COKE)
11
LEAD
28
24
26
12

LEAD SMELTING METHOD

BACKGROUND OF THE INVENTION

This invention relates to a method of smelting lead and more particularly to a method of smelting lead in an electric arc furnace.

Impurities are normally removed from lead scrap and low grade lead ore by smelting in blast furnaces or reverberatory furnaces. In such prior art methods, lead was melted in the presence of a reducing agent, such as coke. These methods were satisfactory so long as the lead scrap employed was obtained from relatively controlled sources so as to limit the degree and variety of impurities. However, as the sources of lead scrap are increased, some difficulty has been experienced with these prior art methods. For example, in the case of reverberatory furnaces, heat transferred from the gas burners is inhibited by larger quantities of slag incident to higher impurity levels. Also, in blast furnaces, higher impurity levels alter the physical and thermal properties of the lead which interferes with the downward flow of metal through the furnace stack. These prior art methods also increase pollution control problems because they involve the combustion of fuel which substantially increases the volume of off-gases which must be cleaned.

SUMMARY OF THE INVENTION

It is an object of the invention to provide a new and improved method of smelting lead.

Another object of the invention is to provide a method of smelting lead in an electric arc furnace.

A further object of the invention is to provide a method of smelting lead from feed materials having high impurity levels.

A still further object of the invention is to provide a method of smelting lead which is sufficiently flexible to permit the use of a variety of scrap sources or low grade ores.

These and other objects and advantages of the present invention will become more apparent from the detailed description thereof taken with the accompanying drawing.

In general terms, the method comprises the steps of containing a quantity of lead in an electric arc furnace, disposing a layer of a granular carbonaceous material over the lead, disposing at least two electrodes on the surface of the carbonaceous material and in spaced apart relation, passing an electric current through said carbonaceous material and between said electrodes for generating resistance heating in said carbonaceous material, and transferring heat from said carbonaceous material to said lead for heating said lead to at least its fusion temperature.

BRIEF DESCRIPTION OF THE DRAWING

The single FIGURE of the drawing shows an electric arc furnace in which the method of the present invention may be practiced.

DESCRIPTION OF THE PREFERRED EMBODIMENT

The drawing schematically illustrates an electric arc furnace 10 having a furnace body defined by generally cylindrical side walls 11 and a shallow dished hearth 12. The upper end of the furnace 10 is closed by an arched roof 14 which has a plurality of apertures 16 for receiving pairs of electrodes 18 which may be carbon or a suitable non-consumable type. The roof 14 may be provided with an aperture 20 to permit off-gases generated within the furnace 10 to be collected by a gas cleaning system symbolized by the gas collecting hood 22. In addition, a trough 24 is formed integrally at one side of the vessel 10 and communicates with the lower portion thereof through an aperture 26 formed in the lower end of side wall 11.

In performing the method according to the invention, lead scrap or low grade ore is charged into the furnace 11 and the upper surface thereof is covered with a layer of granules of a carbonaceous material. This may take the form of coke or carbon. After the carbonaceous material has been distributed over the surface of the lead, the electrodes 18 are positioned with their tips immersed into the coke layer and at spaced apart locations. The electrodes are then energized with direct or alternating current so that an electric potential will exist between the electrodes and through the layer of carbonaceous material which is electrically conductive. As a result, a current will flow through the layer of carbonaceous material generating resistance heat. Because the excellent thermal conductivity of the lead, heat is transmitted through all portions of the lead charge which fuses at about 327.° C. Because the lead is almost completely impervious to carbon, consumption of the carbonaceous material is relatively small. The molten lead runs through the channel 26 and into the trough 24 from which it can be pumped for further treatment. By removing the lead in this manner, the highly oxidizable carbon is not exposed to the atmosphere.

In one example of the method according to the invention, an ingot of plumber's lead was placed on the bottom of a furnace and the upper surface was covered with metallurgical coke. The furnace was equipped with two three-inch diameter carbon electrodes. Initially, the tips of the electrodes were brought close together as shown by broken lines in the drawing and an arc was struck. Sufficient electrical potential was then applied between the electrodes which were then lowered into engagement with the coke and separated causing current to flow through the coke which generated sufficient heat to melt the lead charge.

While only a single embodiment of the invention has been illustrated and described, it is not intended to be limited thereby but only by the scope of the appended claims.

I claim:

1. A method of smelting lead comprising the steps of containing a quantity of lead in solid form an electric arc furnace, disposing a layer of granular carbonaceous material over said lead, disposing at least two electrodes in engagement with said carbonaceous material and in spaced apart relation, passing an electric current through said carbonaceous material and between said electrodes for generating resistance heating in carbonaceous material, transferring heat from said carbonaceous material to said lead, and continuing the energization of said electrodes until said lead material is fused.

2. The method set forth in claim 1 wherein said carbonaceous material is coke.

3. The method set forth in claim 1 wherein said carbonaceous material is carbon.

4. The method set forth in claims 2 or 3 and including the step of placing said electrodes in close proximity and striking an arc therebetween prior to engagement of said electrodes with said carbonaceous material, thereafter lowering said electrodes into engagement with said carbonaceous material and separating the same to cause the current to flow therebetween and through said carbonaceous material.

5. The method set forth in claim 4 wherein said lead comprises scrap.

6. The method set forth in claim 4 wherein said lead is low grade ore.

* * * * *